US008622528B2

(12) United States Patent
Shimada

(10) Patent No.: US 8,622,528 B2
(45) Date of Patent: Jan. 7, 2014

(54) PIEZOELECTRIC ELEMENT, LIQUID EJECTING HEAD, LIQUID EJECTING APPARATUS, AND METHOD FOR MANUFACTURING PIEZOELECTRIC ELEMENT

(75) Inventor: Masato Shimada, Chino (JP)

(73) Assignee: Seiko Epson Corporation, Tokyo (JP)

( * ) Notice: Subject to any disclaimer, the term of this patent is extended or adjusted under 35 U.S.C. 154(b) by 89 days.

(21) Appl. No.: 13/224,290

(22) Filed: Sep. 1, 2011

(65) Prior Publication Data

US 2012/0056944 A1 Mar. 8, 2012

(30) Foreign Application Priority Data

Sep. 3, 2010 (JP) ..... 2010-197432

(51) Int. Cl.
*B41J 2/045* (2006.01)

(52) U.S. Cl.
USPC ..... 347/70; 347/71; 347/72; 347/68; 29/25.35

(58) Field of Classification Search
USPC ..... 347/68–72; 310/364, 363, 365; 29/25.35
See application file for complete search history.

(56) References Cited

U.S. PATENT DOCUMENTS

2004/0090500 A1* 5/2004 Murai ..... 347/70
2009/0085443 A1* 4/2009 Hishinuma et al. ..... 310/364
2009/0219345 A1* 9/2009 Yazaki et al. ..... 347/68
2009/0229126 A1* 9/2009 Oguri ..... 29/890.1
2009/0244208 A1 10/2009 Shimada
2009/0244209 A1 10/2009 Shimada
2009/0244210 A1 10/2009 Shimada
2009/0244212 A1 10/2009 Shimada

FOREIGN PATENT DOCUMENTS

JP 2009-196329 A 9/2009
JP 2009-255529 A 11/2009
JP 2009-255530 A 11/2009
JP 2009-255531 A 11/2009
JP 2009-255532 A 11/2009
JP 2009-255536 A 11/2009

* cited by examiner

*Primary Examiner* — Henok Legesse
(74) *Attorney, Agent, or Firm* — Kilpatrick Townsend & Stockton LLP

(57) ABSTRACT

A first lead electrode containing nickel and chromium contacts a second upper electrode containing titanium. Here, since a difference between the normal electrode potential of nickel and chromium and the normal electrode potential of titanium is smaller than a difference between the normal electrode potential of nickel and chromium and the normal electrode potential of iridium, electric corrosion can be made difficult to occur as compared with the case where the first lead electrode containing nickel and chromium contacts a first upper electrode containing iridium. Therefore, a piezoelectric element can be obtained in which an increase in resistance due to the narrowing of the contact area between an upper electrode and a lead electrode for upper electrode or the separation of the lead electrode for upper electrode can be suppressed and which can be driven by a given voltage.

12 Claims, 7 Drawing Sheets

PIEZOELECTRIC ELEMENT, LIQUID EJECTING HEAD, LIQUID EJECTING APPARATUS, AND METHOD FOR MANUFACTURING PIEZOELECTRIC ELEMENT

THIS APPLICATION CLAIMS A PRIORITY TO JAPANESE PATENT APPLICATION NO. 2010-197432 FILED ON SEP. 3, 2010 WHICH IS HEREBY EXPRESSLY INCORPORATED BY REFERENCE HEREIN IN ITS ENTIRETY.

BACKGROUND

1. Technical Field

The present invention relates to a piezoelectric element having an electrode and a lead wiring connected to the electrode and a method for manufacturing the same, and a liquid ejecting head and a liquid ejecting apparatus having the piezoelectric element.

2. Related Art

A piezoelectric body containing crystals typified by lead zirconate titanate (PZT) and the like has piezoelectric effects and the like, and therefore is applied to a piezoelectric element. The piezoelectric element has a pair of electrodes, the electrodes on which a lead wiring for connecting to an external drive circuit or the like is formed.

Moreover, known are an ink jet recording head as a liquid ejecting head and an ink jet recording device as a liquid ejecting apparatus, in which a piezoelectric element as a pressure generating unit is provided in a pressure generating chamber communicating with a nozzle opening that ejects ink as liquid, and ink in the pressure generating chamber is pressurized to thereby eject the ink from the nozzle opening.

The piezoelectric element adopted in the ink jet recording head has, for example, a piezoelectric layer sandwiched between a lower electrode and an upper electrode. Here, there is a problem in that the piezoelectric layer is easily broken due to the external environment, such as humidity. In order to solve the problem, a piezoelectric element is mentioned in which the lower electrode is used as an individual electrode and the upper electrode is used as a common electrode, and the piezoelectric layer is covered with the upper electrode (e.g., JP-A-2009-196329).

On the upper electrode, a lead wiring for connecting an external drive circuit or the like and the upper electrode by bonding or the like is formed. Known as the lead electrode is one having an adhesion layer and a metal layer. The lead electrode is obtained by patterning (e.g., JP-A-2009-255536).

However, in patterning the lead electrode by wet etching, when an electrical conductor constituting the upper electrode as a common electrode and an electrical conductor constituting the adhesion layer of the lead electrode are different from each other, current flows through an etching solution due to differences in the ionization tendency between the electrical conductors, so that the electrical conductors melt in the etching solution, which causes electric corrosion. In particular, when the area of the common electrode is larger than the area of the individual electrode, Pt or Ir is used for the common electrode, and Ni, Ti, Cr, or the like is used for the adhesion layer of the lead electrode, a large amount of current flows through the etching solution, resulting in further progress of the electric corrosion in the adhesion layer of the lead electrode. When electric corrosion arises in the adhesion layer, the contact area between the upper electrode and the lead electrode become narrows or the separation of the lead electrode arises, which makes it difficult to obtain a piezoelectric element that can be driven by a predetermined voltage.

Moreover, current flows also through moisture or the like adhering to the surface of the common electrode and the surface of the lead electrode, which causes electric corrosion in the adhesion layer, which makes it difficult to maintain a piezoelectric element that can be driven by a given voltage and a liquid ejecting head and a liquid ejecting apparatus having the same.

The given voltage refers to a voltage for generating the deformation amount required for driving the piezoelectric element. When the contact area between the upper electrode and the lead electrode becomes narrow or the separation of the lead electrode arises, so that the resistance between the upper electrode and the lead electrode becomes high, a voltage for generating the deformation amount required for driving the piezoelectric element cannot be applied.

SUMMARY

The invention has been made in order to solve at least one of the above-described problems, and can be realized as the following aspects or application examples.

APPLICATION EXAMPLE 1

A piezoelectric element has: two or more lower electrodes formed in parallel; a piezoelectric layer formed on each of the lower electrodes; an upper electrode that is formed on the piezoelectric layers in such a manner as to face the two or more lower electrodes and that has a first upper electrode containing iridium and a second upper electrode containing titanium as the top layer; and a lead electrode having a first lead electrode that is formed in connection to the second upper electrode and contains nickel and chromium and a second lead electrode formed on the first lead electrode, in which the upper electrode is formed in common over the direction where the lower electrodes are arranged in parallel.

According to this application example, the first lead electrode containing nickel and chromium contacts the second upper electrode containing titanium. Here, since a difference between the normal electrode potential of nickel and chromium and the normal electrode potential of titanium is smaller than a difference between the normal electrode potential of nickel and chromium and the normal electrode potential of iridium, electric corrosion is difficult to occur as compared with the case where the first lead electrode containing nickel and chromium contacts the first upper electrode containing iridium. Therefore, a piezoelectric element is obtained in which the narrowing of the contact area between the upper electrode and the lead electrode or the separation of the lead electrode can be suppressed and which can be driven by a given voltage.

APPLICATION EXAMPLE 2

In the piezoelectric element above, the second lead electrode contains gold.

In this application example, since the second lead electrode contains gold, the resistance becomes low. Therefore, a piezoelectric element is obtained that can be driven by a lower voltage.

APPLICATION EXAMPLE 3

A liquid ejecting head has a pressure generating chamber communicating with a nozzle opening that ejects liquid and the piezoelectric element above as a pressure generating unit for changing the pressure of the pressure generating chamber.

According to this application example, a liquid ejecting head having the above-described effects is obtained.

APPLICATION EXAMPLE 4

A liquid ejecting apparatus has the liquid ejecting head above.

According to this application example, a liquid ejecting apparatus having the above-described effects is obtained.

APPLICATION EXAMPLE 5

A method for manufacturing a piezoelectric element, includes: a lower electrode formation process for forming two or more lower electrodes; a piezoelectric layer formation process for forming a piezoelectric layer on each of the lower electrodes; a first upper electrode film formation process for forming a first upper electrode film facing the two or more lower electrodes and containing iridium on the piezoelectric layers; a second upper electrode film formation process for forming a second upper electrode film containing titanium as the top layer of an upper electrode on the first upper electrode film; an upper electrode formation process for forming the upper electrode having a first upper electrode and a second upper electrode by patterning the first upper electrode film and the second upper electrode film; a first lead electrode film formation process for forming a first lead electrode film containing nickel and chromium on the second upper electrode; a second lead electrode film formation process for forming a second lead electrode film on the first lead electrode film; and a lead electrode formation process for forming a lead electrode having a first lead electrode and a second lead electrode by etching the first lead electrode film and the second lead electrode film by wet etching.

According to this application example, the first lead electrode film containing nickel and chromium contacts the second upper electrode containing titanium. Here, since a difference between the normal electrode potential of nickel and chromium and the normal electrode potential of titanium is smaller than a difference between the normal electrode potential of nickel and chromium and the normal electrode potential of iridium. Therefore, electric corrosion is difficult to occur in the first lead electrode film when etching the first lead electrode film by wet etching in the lead electrode formation process as compared with the case where the first lead electrode film containing nickel and chromium contacts the first upper electrode containing iridium. Therefore, a piezoelectric element is obtained in which the narrowing of the contact area between the upper electrode and the lead electrode or the separation of the lead electrode can be suppressed and which can be driven by a given voltage.

APPLICATION EXAMPLE 6

In the method for manufacturing a piezoelectric element above, the second lead electrode film contains gold.

In this application example, since the second lead electrode obtained by wet etching the second lead electrode film contains gold, the resistance becomes low. Therefore, a method for manufacturing a piezoelectric element that can be driven by a lower voltage is obtained.

APPLICATION EXAMPLE 7

In the method for manufacturing a piezoelectric element above, the first lead electrode film is wet etched with an aqueous mixed solution containing ammonium cerium nitrate and nitric acid.

In this application example, a method for manufacturing a piezoelectric element in which the first lead electrode film can be more efficiently wet etched is obtained.

APPLICATION EXAMPLE 8

In the method for manufacturing a piezoelectric element above, the second lead electrode film is wet etched with an aqueous mixed solution containing iodine and potassium iodide.

In this application example, a method for manufacturing a piezoelectric element in which the second lead electrode film can be more efficiently wet etched is obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments will be described in detail with reference to the drawings.

Figure 1:
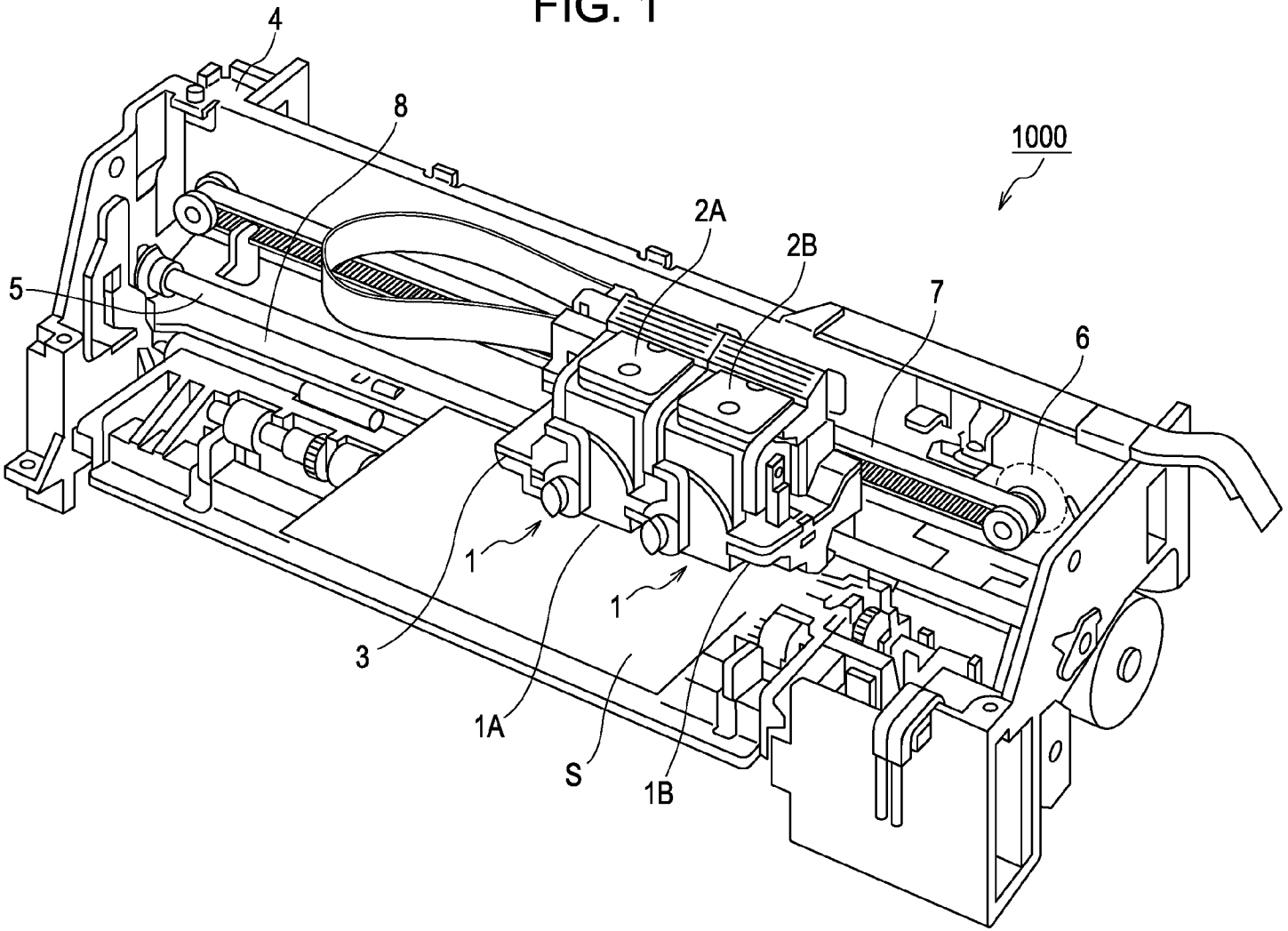
FIG. 1 is a schematic view illustrating an example of an ink jet recording device according to embodiments.

FIG. 1 is a schematic view illustrating an example of an ink jet recording device 1000 as a liquid ejecting apparatus in this embodiment. The ink jet recording device 1000 is a device that performs recording on a recording sheet S as a recording medium by ejecting ink as liquid.

In FIG. 1, the ink jet recording device 1000 has a recording head unit 1A and a recording head unit 1B each having an ink jet recording head 1 as a liquid ejecting head. In the recording head units 1A and 1B, cartridges 2A and 2B constituting an ink supply unit are detachably provided.

Here, the ink jet recording heads 1 are provided on the side of each of the recording head units 1A and 1B facing the recording sheet S, and are not illustrated in FIG. 1.

A carriage 3 on which the recording head units 1A and 1B are mounted is provided on a carriage shaft 5 attached to a device body 4 in such a manner as to freely move in the axial direction. The recording head units 1A and 1B eject, for example, a black ink composition and a color ink composition, respectively.

By transmission of driving force of a drive motor 6 to the carriage 3 through two or more gears, which are not illustrated, and a timing belt 7, the carriage 3 on which the recording head units 1A and 1B are mounted move along the carriage shaft 5.

In contrast, a platen 8 is provided in a device body 4 along the carriage 3. The platen 8 is designed to be able to rotate by driving force or the like of a paper feed motor, which is not illustrated. The recording sheet S as a recording media, such as paper, that is fed by a paper feed roller or the like is wound around the platen 8 to be transported.

Figure 2:
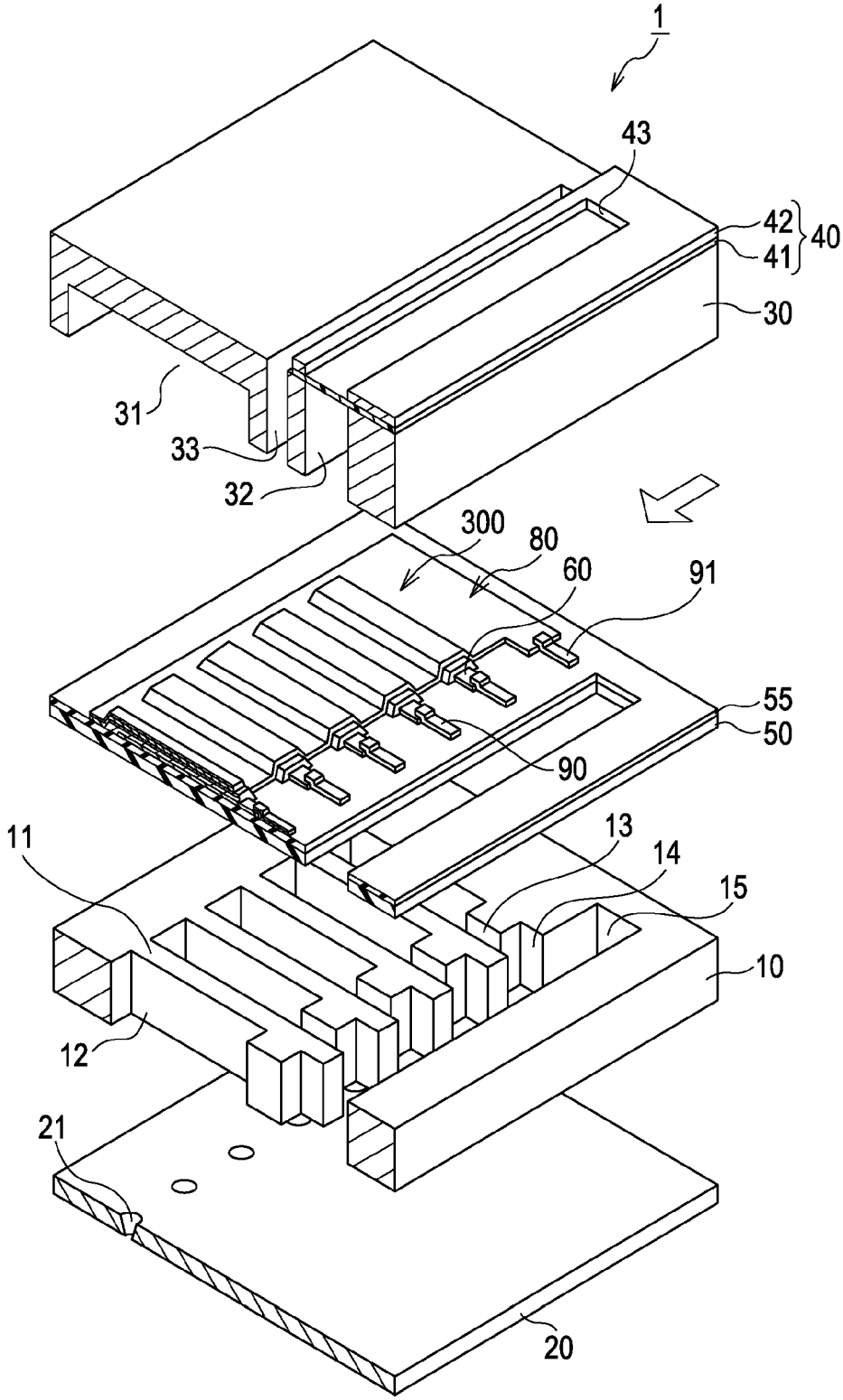
FIG. 2 is a partially exploded perspective view schematically illustrating an ink jet recording head.

FIG. 2 illustrates a partially exploded perspective view illustrating the ink jet recording head 1 according to this embodiment. The shape of the ink jet recording head 1 is a substantially rectangular parallelepiped. FIG. 2 is a partially exploded perspective view taken along the surface orthogonal to the longitudinal direction (the direction indicated by the white arrow in FIG. 2) of the ink jet recording head 1.

Figure 3A:
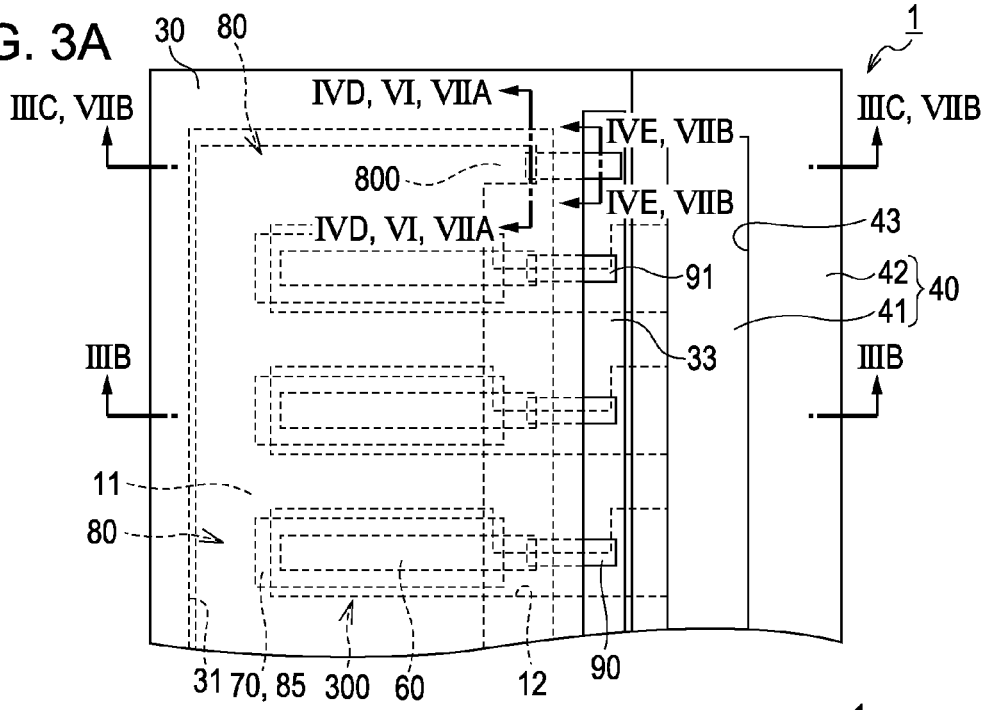
FIG. 3A is a partial plan view of an ink jet recording head.
Figure 3B:
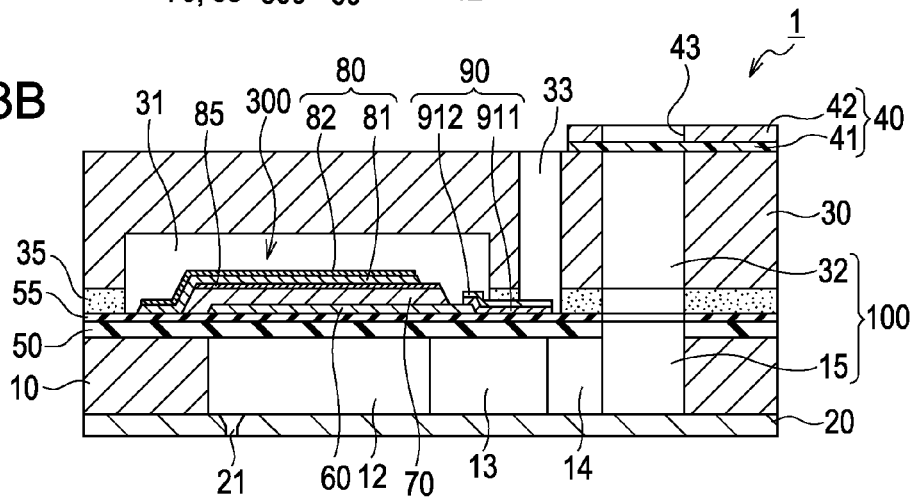
FIG. 3B is a schematic cross sectional view along the IIIB-IIIB line of FIG. 3A.
Figure 3C:
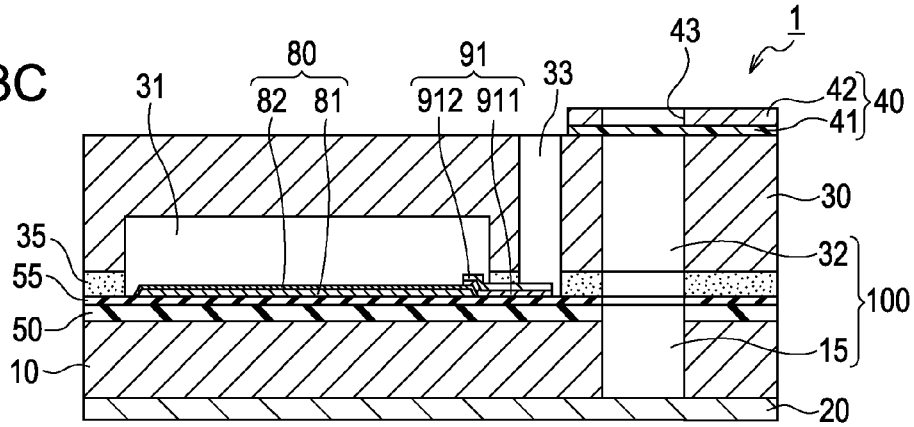
FIG. 3C is a schematic cross sectional view along the IIIC-IIIC line of FIG. 3A.
Figure 4D:
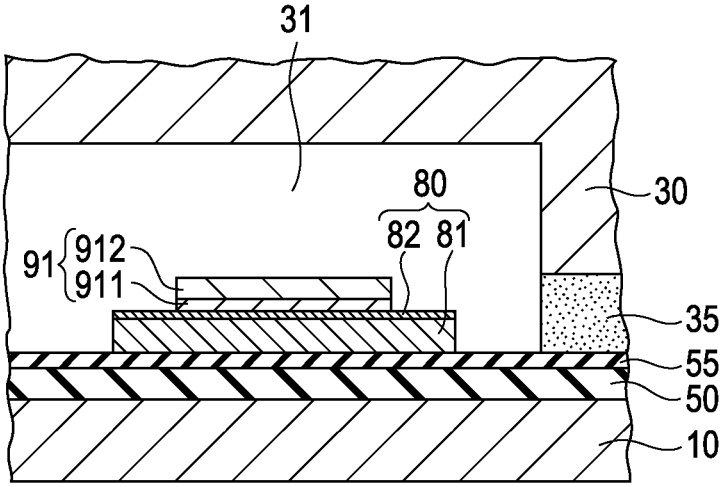
FIG. 4D is a partially schematic cross sectional view along the IVD-IVD line of FIG. 3A of an ink jet recording head and FIG. 4E is a partially schematic cross sectional view along the IVE-IVE line of FIG. 3A.
Figure 4E:
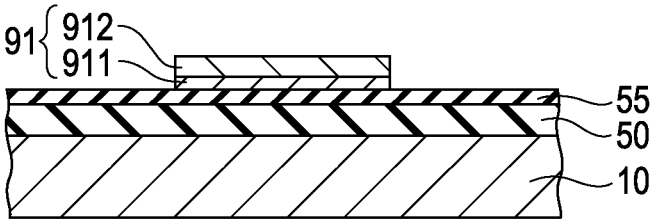

FIG. 3A illustrates a partial plan view of the ink jet recording head 1 and FIG. 3B illustrates a schematic cross sectional view along the IIIB-IIIB line of FIG. 3A. FIG. 3C is a schematic cross sectional view along the IIIC-IIIC line of FIG. 3A. FIG. 4D is a partially schematic cross sectional view along the IVD-IVD line of FIG. 3A. FIG. 4E is a partially schematic cross sectional view along the IVE-IVE line of FIG. 3A.

In FIG. 2 and FIGS. 3A and 3B, the ink jet recording head 1 has a flow path formation substrate 10, a nozzle plate 20, a protective substrate 30, and a compliance substrate 40.

The flow path formation substrate 10, the nozzle plate 20, and the protective substrate 30 are stacked in such a manner as to sandwich the flow path formation substrate 10 with the nozzle plate 20 and the protective substrate 30 and the compliance substrate 40 is formed on the protective substrate 30.

The flow path formation substrate 10 contains a silicon single crystal substrate having a crystal plane orientation of (110) in this embodiment, and an elastic film 50 containing an oxide film is formed on one surface. In the flow path formation substrate 10, two or more pressure generating chambers 12 which are divided by partitions 11 and one surface of which is constituted from the elastic film 50 are disposed in parallel.

The flow path formation substrate 10 is provided with ink supply paths 13 and communicating paths 14 which are divided by the partitions 11 and which communicate with each pressure generating chamber 12 at the side of one end portion in the longitudinal direction of the pressure generating chambers 12. At the outside of the communicating paths 14, a communicating portion 15 communicating with each of the communicating paths 14 is provided. The communicating portion 15 communicates with a reservoir portion 32 of the protective substrate 30 described later to thereby constitute a part of a manifold 100 serving as a common ink chamber of each pressure generating chamber 12.

Here, the ink supply path 13 is formed in such a manner as to be narrower than the pressure generating chamber 12 in the cross sectional area and maintains the flow path resistance of ink flowing into the pressure generating chambers 12 from the communicating portion 15 at a fixed rate. For example, the ink supply paths 13 are formed with a width smaller than the width of the pressure generating chambers 12 by narrowing the flow path at the side of the pressure generating chamber 12 between the manifold 100 and each pressure generating chamber 12 in the width direction.

In this embodiment, the ink supply paths 13 are formed by narrowing the width of the flow path from one side but the ink supply paths may be formed by narrowing the width of the flow path from both sides. The ink supply paths may be formed by not narrowing the width of the flow paths but narrowing in the thickness direction. Each communicating path 14 is formed by extending the partitions 11 at both sides in the width direction of the pressure generating chambers 12 to the communicating portion 15 and dividing the space between the ink supply paths 13 and the communicating portion 15.

As the materials of the flow path formation substrate 10, a silicon single crystal substrate is used in this embodiment but it is matter of course that the materials are not limited thereto and, for example, glass ceramics, stainless steel, and the like may be used.

In the nozzle plate 20, nozzle openings 21 communicating with the pressure generating chambers 12 are formed near the end portion opposite to the ink supply path 13 of each pressure generating chamber 12.

The nozzle plate 20 has a thickness of 0.01 mm to 1.00 mm and contains, for example, glass ceramics, a silicon single crystal substrate, or stainless steel.

The flow path formation substrate 10 and the nozzle plate 20 are stuck to each other with adhesives, a thermal fusion film, or the like.

The elastic film 50 formed on the surface of the flow path formation substrate 10 facing the surface to which the nozzle plate 20 is stuck contains an oxide film formed by thermal oxidation. For example, the elastic film 50 having a thickness of 0.50 μm to 2.00 μm is formed.

On the elastic film 50 of the flow path formation substrate 10, an insulator film 55 containing a zirconium oxide film having a thickness of, for example, about 0.40 μm is formed. These films constitute a diaphragm as a substrate.

The elastic film 50 and the insulator film 55 constituting the diaphragm can be, for example, a layer of at least one substance selected from zirconium dioxide or aluminum oxide or a laminate of these layers, in addition to silicon oxide.

On the insulator film 55, the lower electrodes 60 having a thickness of, for example, about 0.20 μm, the piezoelectric layers 70 having a thickness of, for example, about 1.30 μm as a piezoelectric body having a perovskite structure, and the upper electrode 80 having a thickness of, for example, about 0.05 μm, are further formed to thereby constitute a piezoelectric element 300 as a pressure generating unit.

Here, the piezoelectric element 300 includes not only a portion including the lower electrode 60, the piezoelectric layer 70, and the upper electrode 80 but a portion at least including the piezoelectric layer 70. For example, the piezoelectric element 300 also includes lead electrodes connected to the lower electrode 60 and the upper electrode 80.

In general, any one of the electrodes of the piezoelectric element 300 is used as a common electrode and the other electrode is patterned with the piezoelectric layer 70 for each pressure generating chamber 12 to form an individual electrode. Here, the piezoelectric element 300 and the diaphragm that is deformed by driving of the piezoelectric element 300 are collectively referred to as a piezoelectric actuator.

The diaphragm has a function of vibrating by driving of the piezoelectric element 300. The diaphragm is deformed by the motion of the piezoelectric element 300 to thereby change the volume of the pressure generating chambers 12. When the volume of the pressure generating chambers 12 which are charged with ink becomes small, the pressure inside the pressure generating chambers 12 becomes high, so that the ink is ejected from the nozzle openings 21 of the nozzle plate 20.

Here, the structure of the piezoelectric element 300 according to this embodiment will be described in detail.

In FIG. 3A, the lower electrode 60 constituting the piezoelectric element 300 is provided with a width narrower than the width of the pressure generating chamber 12 for each region facing the pressure generating chamber 12, i.e., two or more of the lower electrode 60 are provided, and constitutes an individual electrode of each piezoelectric element 300. Moreover, the lower electrode 60 is extended from the side of one end portion in the longitudinal direction of each of the pressure generating chambers 12 to a portion above the wall around the pressure generating chamber 12.

To the lower electrodes 60, a lead electrode for lower electrode 90 containing, for example, gold or the like as a lead electrode is connected in a region outside each of the pressure generating chambers 12, so that a voltage is selectively applied to each of the piezoelectric elements 300 through the lead electrode for lower electrode 90. In contrast, the end portion of the lower electrode 60 at the side of the other end portion in the longitudinal direction of the pressure generating chamber 12 is positioned in the region facing the pressure generating chamber 12.

The materials of the lower electrodes 60 are not particularly limited insofar as the materials have conductivity and, for example, various kinds of metals, such as nickel, iridium, and platinum, conductive oxides thereof (e.g., iridium oxide), a complex oxide of strontium and ruthenium, a complex oxide of lantern and nickel, and the like can be used.

The piezoelectric layer 70 is provide with a width larger than the width of the lower electrode 60 and with a width narrower than the width of the pressure generating chamber 12. In the longitudinal direction of the pressure generating chamber 12, both ends of the piezoelectric layer 70 are extended beyond the end portions of the pressure generating chamber 12. More specifically, the piezoelectric layer 70 is provided in such a manner as to cover the upper surface and the end surface of the lower electrode 60 in the region facing the pressure generating chamber 12. The end portion of the piezoelectric layer 70 at the side of one end portion in the longitudinal direction of the pressure generating chamber 12 is positioned near the end of the pressure generating chamber 12, and the lower electrode 60 is further extended to a region outside of the end portion.

As the piezoelectric layer 70, a perovskite type oxide represented by General Formula $ABO_3$ can be preferably used. Specifically mentioned are lead zirconate titanate ($Pb(Zr, Ti)O_3$) (PZT), lead zirconate titanate niobate ($Pb(Zr, Ti, Nb)O_3$) (PZTN (Registered Trademark)), barium titanate ($BaTiO_3$), potassium sodium niobate ($(K, Na)NbO_3$), and the like.

The piezoelectric layer 70 is deformed by the application of an electric field by the lower electrode 60 and the upper electrode 80, to thereby perform mechanical output. The deformation amount is determined in accordance with the voltage to be applied. Therefore, a given voltage to be applied is set in accordance with the deformation amount required for driving the piezoelectric element 300.

The upper electrode 80 is continuously formed in a region facing the two or more lower electrodes 60 and the two or more pressure generating chambers 12 and is extended from the side of the other end portion in the longitudinal direction of the pressure generating chambers 12 to a portion above the wall around the pressure generating chambers 12. More specifically, the upper electrode 80 is formed in such a manner as to cover almost the entire region of the upper surface and the end surface of the piezoelectric layer 70 in the region facing the pressure generating chamber 12. Thus, the penetration of moisture in the atmosphere into the piezoelectric layer 70 is substantially prevented. Therefore, the piezoelectric layer 70 can be prevented from breaking due to moisture, and thus the durability of the piezoelectric element 300 can be remarkably improved.

The thickness of the upper electrode 80 is, for example, 2 nm to 100 nm and contains iridium.

The end portion of the upper electrode 80 at the side of the other end portion in the longitudinal direction of the pressure generating chamber 12 is positioned in the region facing the pressure generating chamber 12 and a substantial actuator of the piezoelectric element 300 is provided in the region facing the pressure generating chamber 12. More specifically, the piezoelectric element 300 of a portion between the end portion of the lower electrode 60 and the end portion of the upper electrode 80 positioned in the pressure generating chamber 12 serves as a substantial actuator. Therefore, even when the piezoelectric element 300 is driven, severe deformation does not arise in the diaphragm containing the elastic film 50 and the insulator film 55 in the vicinity of both ends in longitudinal direction of the pressure generating chamber 12, so that the generation of cracks in the diaphragm of this portion can be prevented.

In such a structure, the surface of the piezoelectric layer 70 is slightly exposed even in the region facing the pressure generating chamber 12. However, the exposed portion is not a substantial actuator, the area thereof is very narrow, and the distance between the peripheral portion of the upper electrode 80 and the lower electrode 60 is large as described later, and therefore the breakage of the piezoelectric layer 70 resulting from moisture can be prevented.

Further, an intermediate film 85 is provided between the upper electrode 80 and the piezoelectric layer 70. The intermediate film 85 contains materials having conductivity and substantially functions as one part of the upper electrodes 80. More specifically, since the intermediate film 85 is formed from conductive materials and contacts the upper electrode 80, the conductivity as the upper electrode 80 can be compensated.

Although described later, the intermediate film 85 is patterned with the piezoelectric layer 70, and has a function of preventing the piezoelectric layer 70 from being damaged during manufacturing. Therefore, the intermediate film 85 is formed only on the upper surface of the piezoelectric layer 70.

The intermediate film 85 is not always required and may be not formed.

The upper electrode 80 has a two-layer structure containing a first upper electrode 81 containing iridium and a second upper electrode 82 containing titanium as the top layer, for example. The second upper electrode 82 also includes a natural oxidation film of titanium thinly formed on the surface of the second upper electrode 82.

The upper electrode 80 is not limited to the two-layer structure described in this embodiment and may be a structure of three or more layers in which another layer is formed between the first upper electrode 81 and the second upper electrode 82.

At the end of the upper electrode 80 in the longitudinal direction of the ink jet recording head 1, an upper electrode drawing portion 800 is formed. The upper electrode drawing portion 800 is extended to the same side as the side on which the lead electrode for lower electrode 90 is formed.

On the upper electrode drawing portion 800, a lead electrode for upper electrode 91 as a lead electrode is formed. The upper electrode drawing portion 800 and the lead electrode for upper electrode 91 will be described below in detail.

In FIG. 3C and FIG. 4D, the lead electrode for upper electrode 91 is formed from the top of the upper electrode drawing portion 800 over the direction in which the lead electrode for lower electrode 90 extends. The lead electrode for upper electrode 91 is a two-layer structure having a first lead electrode 911 formed on the second upper electrode 82 and a second lead electrode 912 formed on the first lead electrode 911. The lead electrode for upper electrode 91 is formed in such a manner that the first lead electrode 911 and the second upper electrode 82 contact.

The first lead electrode 911 contains nickel and chromium and the second lead electrode 912 contains, for example, gold.

The lead electrode for upper electrode 91 is not limited to the two-layer structure described in this embodiment and may be a structure of three or more layers in which another layer is formed between the first lead electrode 911 and the second lead electrode 912. Here, the structure of the lead electrode for lower electrode 90 can also be made the same as the structure of the lead electrode for upper electrode 91. In this case, the lead electrode for lower electrode 90 and the lead electrode for upper electrode 91 can be formed in the same process.

In FIG. 4E, the lead electrode for upper electrode 91 is formed on the elastic film 50 and the insulator film 55 in a portion other than the region where the upper electrode drawing portion 800.

In FIG. 2, FIG. 3A, and FIG. 3B, the protective substrate 30 having a piezoelectric element holding portion 31 capable of securing a space that does not inhibit the movement of the piezoelectric element 300 in a region facing the piezoelectric element 300 is joined onto a flow path formation substrate 10, on which the piezoelectric element 300 is formed, through an adhesive 35. The piezoelectric element 300 is formed in the piezoelectric element holding portion 31, and therefor is protected in a state where the piezoelectric element 300 is hardly affected by the influence of the external environment.

In the protective substrate 30, a reservoir portion 32 is provided in a region corresponding to the communicating portion 15 of the flow path formation substrate 10. The reservoir portion 32 is provided along the arrangement direction of the pressure generating chambers 12 in such a manner as to penetrate the protective substrate 30 in the thickness direction and is made to communicate with the communicating portion 15 of the flow path formation substrate 10 to thereby constitute the manifold 100 serving as a common ink chamber of each pressure generating chamber 12 as described above.

In this embodiment, the piezoelectric element holding portion 31 is integrally provided in a region corresponding to the line of the pressure generating chambers 12 and may be independently provided for each piezoelectric element 300. Mentioned as the materials of the protective substrate 30 are, for example, glass, ceramic materials, metal, resin, and the like. The protective substrate 30 is more preferably formed with materials whose coefficient of thermal expansion is substantially the same as that of the flow path formation substrate 10. In this embodiment, the protective substrate 30 is formed using a silicon single crystal substrate, which is the same material as that of the flow path formation substrate 10, for example.

Furthermore, a through hole 33 that penetrates the protective substrate 30 in the thickness direction is provided in a region between the piezoelectric element holding portion 31 and the reservoir portion 32 of the protective substrate 30. The end portion of the lead electrode for lower electrode 90 and the end portion of the lead electrode for upper electrode 91 are exposed into the through hole 33. The lead electrode for lower electrode 90 and the lead electrode for upper electrode 91 are connected to, for example, a drive IC for driving the piezoelectric element 300 by connection wiring, which is not illustrated, extended into the through hole 33.

A drive signal includes a drive system signal for driving a drive IC, such as a driving power supply signal, and various control system signals, such as a serial signal (SI), and the wiring pattern is constituted by two or more wiring patterns to which each signal is supplied.

Onto the protective substrate 30, a compliance substrate 40 containing a sealing film 41 and a fixation plate 42 is further joined. The sealing film 41 contains materials having low rigidity and flexibility. One surface of the reservoir portion 32 is sealed with the sealing film 41. The fixation plate 42 is formed with hard materials, such as metal. The region of the fixation plate 42 facing the manifold 100 is an opening portion 43 in which the fixation plate 42 is completely removed in the thickness direction. Therefore, one surface of the manifold 100 is sealed only by the sealing film 41 having flexibility.

In such an ink jet recording head 1, ink is taken from the cartridges 2A and 2B illustrated in FIG. 1 and the inside thereof is filled with ink from the manifold 100 to the nozzle openings 21. Thereafter, a drive voltage is applied in accordance with a drive signal from the drive IC between each of the lower electrodes 60 corresponding to each of the pressure generating chambers 12 and the upper electrode 80 to thereby deflectively deform the elastic film 50, the insulator film 55, the lower electrode 60, and the piezoelectric layer 70, so that the pressure in each pressure generating chamber 12 increases, whereby ink droplets are ejected from the nozzle openings 21.

Figure 5:
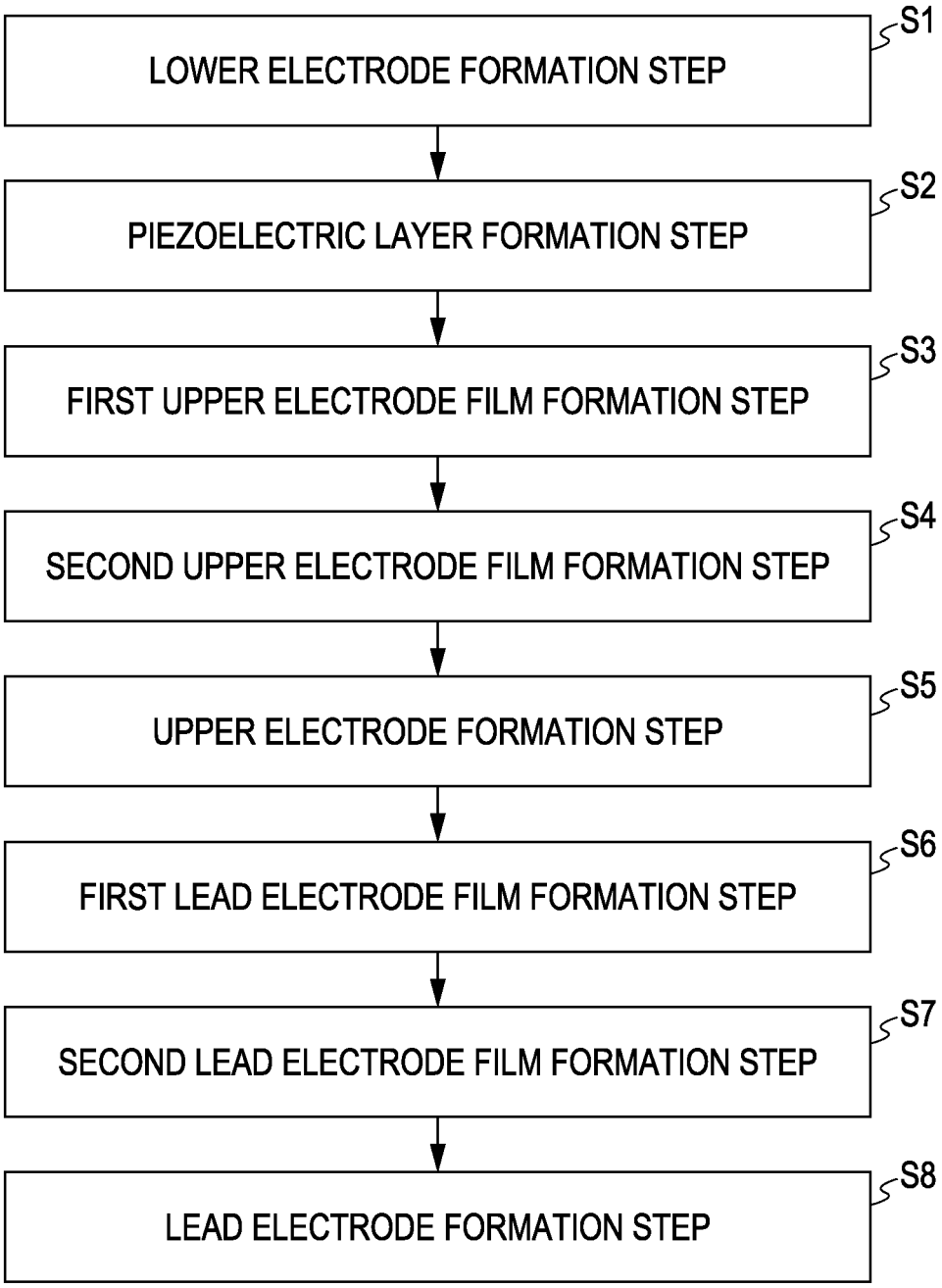
FIG. 5 is a flow chart diagram illustrating a method for manufacturing a piezoelectric element.

Hereinafter, a method for manufacturing such a piezoelectric element 300 will be described with reference to FIG. 5 and FIG. 6 focusing on the formation of the upper electrode 80 and the lead electrode for upper electrode 91. FIG. 5 is a flow chart diagram illustrating a method for manufacturing the piezoelectric element 300. FIGS. 6A to 6G are views equivalent to the partially schematic cross sectional view along the VI-VI line of FIG. 3A of the ink jet recording head 1.

In FIG. 5, the method for manufacturing the piezoelectric element 300 includes Step 1 (S1) which is a lower electrode formation process, Step 2 (S2) which is piezoelectric layer formation process, Step 3 (S3) which is a first upper electrode film formation process, and Step 4 (S4) which is second upper electrode film formation process, Step 5 (S5) which is an upper electrode formation process, Step 6 (S6) as a first lead electrode film formation process, Step 7 (S7) as a second lead electrode film formation process, and Step 8 (S8) as a lead electrode formation process.

Figure 6A:
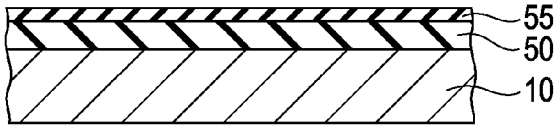
FIGS. 6A to 6G are views illustrating a method for manufacturing a piezoelectric element and are equivalent to the partially schematic cross sectional view along the VI-VI line of FIG. 3A of an ink jet recording heat.
Figure 6B:
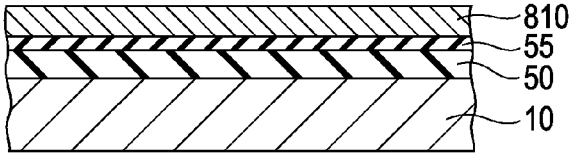
Figure 6C:
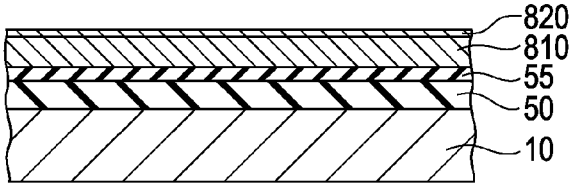
Figure 6D:
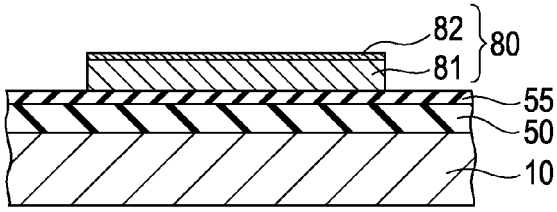
Figure 6E:
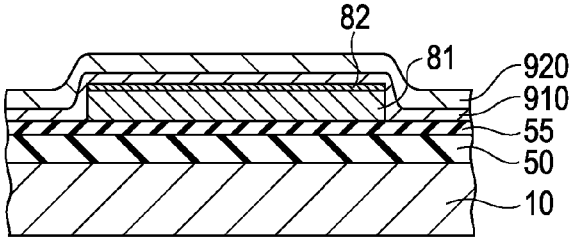
Figure 6F:
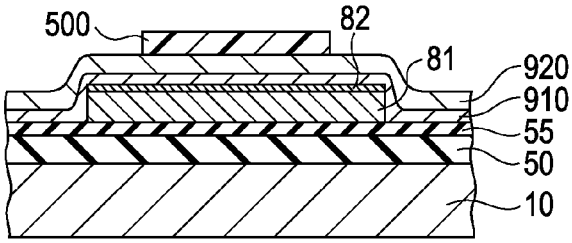
Figure 6G:
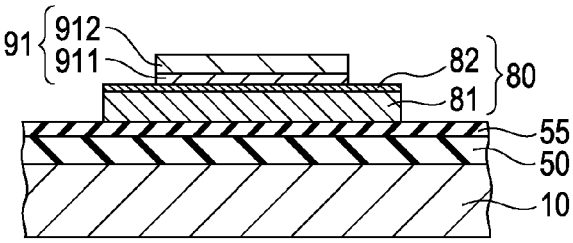

FIG. 6A illustrates a diaphragm formation process, FIG. 6B illustrates the first upper electrode film formation process (S3), FIG. 6C illustrates the second upper electrode film formation process (S4), FIG. 6D illustrates the upper electrode formation process (S5), FIG. 6E illustrates the first lead electrode film formation process (S6) and the second lead electrode film formation process (S7), and FIGS. 6F and 6G illustrate the lead electrode formation process (S8).

The lower electrode formation process (S1) and the piezoelectric layer formation process (S2) are not illustrated in the partially schematic cross sectional view along the VI-VI line, and therefore will be described without reference to the drawings.

In FIG. 6A, in the diaphragm formation process, the elastic film 50 and the insulator film 55 are formed on the flow path formation substrate 10. The elastic film 50 and the insulator film 55 which form one part of the diaphragm can be formed by various methods, such as thermal oxidation, a sputtering method, vacuum deposition, and a CVD method.

In the lower electrode formation process (S1), the lower electrode 60 is formed on the elastic film 50 and the insulator film 55 formed on the flow path formation substrate 10.

The lower electrode 60 illustrated in FIG. 2 and FIGS. 3A to 3C can be formed by forming an electrical conductor film on the flow path formation substrate 10 by various methods, such as a sputtering method, vacuum deposition, and a CVD method, and then patterning the film by photolithography or the like. The lower electrode 60 may be formed by a printing method or the like not requiring patterning.

Furthermore, the lower electrode 60 may be a single layer of the above-described materials or a structure in which two or more of the materials are laminated.

In the piezoelectric layer formation process (S2), a piezoelectric body is first formed on the lower electrode 60.

The piezoelectric body can be formed by a sol gel method, a CVD method, or the like. In the sol gel method, a series of operation of application of a raw material solution, preliminary heating, and crystallization annealing may be repeated two or more times to thereby achieve a given film thickness.

For example, when forming a PZT, the PZT can be formed by a spin coat method, a printing method, or the like using a sol gel solution containing lead, zirconium, and titanium.

The piezoelectric body is formed, and then the intermediate film 85 illustrated in FIG. 3 is formed and then patterned to thereby obtain a piezoelectric layer 70 illustrated in FIG. 3.

In FIG. 6B, in the first upper electrode film formation process (S3), a first upper electrode film 810 is formed on the flow path formation substrate 10. The first upper electrode film 810 can be formed by a sputtering method, vacuum deposition, or the like.

In FIG. 6C, in the second upper electrode film formation process (S4), a second upper electrode film 820 is formed on the first upper electrode film 810. The second upper electrode film 820 can be formed by a sputtering method, vacuum deposition, or the like in the same manner as in the first upper electrode film 810.

In FIG. 6D, in the upper electrode formation process (S5), the first upper electrode film 810 and the second upper electrode film 820 are patterned to thereby form the upper electrode 80 having a first upper electrode 81 and a second upper electrode 82.

In FIG. 6E, in the first lead electrode film formation process (S6) and the second lead electrode film formation process (S7), a first lead electrode film 910 is formed on the flow path formation substrate 10, and then a second lead electrode film 920 is formed on the first lead electrode film 910. These films can be formed by a sputtering method, vacuum deposition, or the like.

In FIG. 6F, in the lead electrode formation process (S8), a resist 500 is formed on the first lead electrode film 910 and the second lead electrode film 920 in a pattern in which the lead electrode for lower electrode 90 and the lead electrode for upper electrode 91 are viewed in plan illustrated in FIG. 2 and FIGS. 3A to 3C.

In FIG. 6G, in the lead electrode formation process (S8), the first lead electrode film 910 and the second lead electrode film 920 are etched by wet etching to thereby form the lead electrode for upper electrode 91 having the first lead electrode 911 and the second lead electrode 912. The resist 500 is removed after forming the lead electrode for upper electrode 91.

The etching method will be described below in more detail.

The second lead electrode film 920 containing gold is wet etched, and then, the first lead electrode film 910 containing nickel and chromium is wet etched. Here, when the second lead electrode film 920 becomes wide after the wet etching of the first lead electrode film 910, the second lead electrode film 920 is wet etched again.

For an etching solution for use in the wet etching, the following liquid can be used, for example.

As an etching solution for the first lead electrode film 910 containing nickel and chromium, an aqueous mixed solution of ammonium cerium nitrate ($Ce(NO_3)_4.2NH_4NO_3$) and nitric acid ($HNO_3$) can be used. The concentration of the ammonium cerium nitrate is preferably 4 wt % to 20 wt % and the concentration of the nitric acid is preferably 4 wt % to 60 wt %.

Usable as a specific etching solution is, for example, an aqueous mixed solution of 15 wt % of ammonium cerium nitrate and 5 wt % of nitric acid or an aqueous mixed solution of 5 wt % of ammonium cerium nitrate and 55 wt % of nitric acid. The liquid can be used with a liquid temperature of 25° C.

As an etching solution for the second lead electrode film 920 containing gold, an aqueous mixed solution of iodine and potassium iodide can be used. For example, an aqueous mixed solution of 5 wt % of iodine, 10 wt % of potassium iodide, and 85 wt % of water can be used. The liquid can be used with a liquid temperature of 23° C.

Figure 7A:
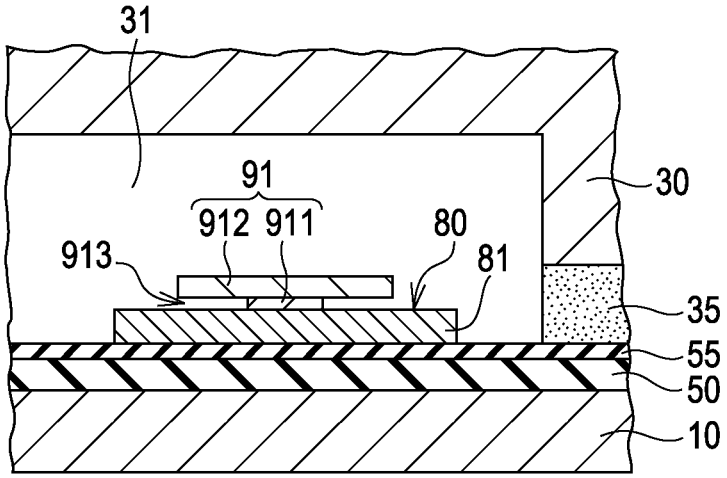
FIG. 7A is a view equivalent to the partially schematic cross sectional view along the VIIA-VIIA line of FIG. 3A of an ink jet recording head in which a second upper electrode is not formed and FIG. 7B is a view equivalent to the partially schematic cross sectional view along the VIIB-VIIB line.
Figure 7B:
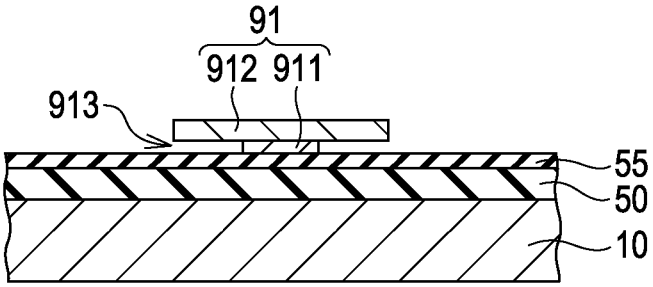

FIGS. 7A and 7B illustrate a case where the second upper electrode 82 formed in the embodiment above is not formed.

FIG. 7A is a view equivalent to a partially schematic cross sectional view along the VIIA-VIIA line of FIG. 3A of the ink jet recording head 1 when the second upper electrode 82 is not formed. FIG. 7B is a view equivalent to a partially schematic cross sectional view along the VIIB-VIIB line of FIG. 3A.

In FIGS. 7A and 7B, when the second upper electrode 82 containing titanium is not formed, the side surface of the first lead electrode film 910 is eroded by electric corrosion during the wet etching process for the first lead electrode film 910 containing nickel and chromium illustrated in FIG. 6G, which results in narrowing of the contact area of the first lead electrode 911 and the first upper electrode 81 of the upper electrode 80.

According to the embodiments described above, the following effects are obtained.

(1) The first lead electrode 911 containing nickel and chromium contacts the second upper electrode 82 containing titanium. Here, since a difference between the normal electrode potential of nickel and chromium and the normal electrode potential of titanium is smaller than a difference between the normal electrode potential of nickel and chromium and the normal electrode potential iridium, electric corrosion can be made difficult to occur as compared with the case where the first lead electrode 911 containing nickel and chromium contacts the first upper electrode 81 containing iridium. Therefore, the piezoelectric element 300 can be obtained in which the narrowing of the contact area between the upper electrode 80 and the lead electrode for upper electrode 91 or the separation of the lead electrode for upper electrode 91 can be suppressed and which can be driven by a given voltage.

(2) Since the second lead electrode 912 contains gold, the resistance can be made low. Therefore, the piezoelectric element 300 can be obtained that can be driven by a lower voltage.

(3) The liquid ejecting head 1 and the ink jet recording device 1000 having the above-described effects can be obtained.

(4) The first lead electrode film 910 containing nickel and chromium contacts the second upper electrode 82 containing titanium. Here, since a difference between the normal electrode potential of nickel and chromium and the normal electrode potential of titanium is smaller than a difference between the normal electrode potential of nickel and chromium and the normal electrode potential of iridium, electric corrosion is difficult to occur in the first lead electrode film 910 when etching the first lead electrode film 910 by wet etching in the lead electrode formation process as compared with the case where the first lead electrode film 910 containing nickel and chromium contacts the first upper electrode 81 containing iridium. Therefore, a method for manufacturing the piezoelectric element 300 can be obtained in which the narrowing of the contact area between the upper electrode 80 and the lead electrode for upper electrode 91 or the separation of the lead electrode for upper electrode 91 can be suppressed and which can be driven by a given voltage.

(5) Since the second lead electrode film 912 obtained by wet etching the second lead electrode film 920 contains gold, the resistance can be made low. Therefore, a method for manufacturing the piezoelectric element 300 that can be driven by a lower voltage can be obtained.

(6) A method for manufacturing the piezoelectric element 300 in which the first lead electrode film 910 and the second lead electrode film 920 can be more efficiently wet etched can be obtained.

The invention can be variously modified in addition to the embodiments described above.

For example, in the embodiments above, two kinds of etching solutions are used for the wet etching performed in the lead electrode formation process (S8) but the first lead electrode film 910 and the second lead electrode film 920 may be etched with one kind of etching solution.

In the embodiments described above, the piezoelectric element 300 is formed in the piezoelectric element holding portion 31 of the protective substrate 30 but the structure is not limited to the structure and the piezoelectric element 300 may be exposed.

In the embodiments described above, the description is given taking the ink jet recording head 1 as an example of a liquid ejecting head but the invention is directed to a wide range of general liquid ejecting heads. It is a matter of course that the invention can be applied also to liquid ejecting heads that eject liquid other than ink. Mentioned as other liquid ejecting heads are, for example, various kinds of recording heads for use in image recorders, such as a printer, color material ejection heads for use in manufacturing of color filters of a liquid crystal display and the like, electrode material ejection heads for use in electrodes formation of an organic EL display, an FED (Field Emission Display), and the like, biological organic material ejection heads for use in manufacturing of bio chips, and the like.

What is claimed is:

1. A piezoelectric element comprising:

a plurality of lower electrodes, comprising at least a first and a second lower electrodes;

a plurality of piezoelectric layers, each of the plurality of piezoelectric layers disposed above each of the plurality of lower electrodes;

at least one upper electrode comprising a first, single upper electrode that is disposed above the piezoelectric layers in such a manner as to face the first and second lower electrodes and that has a first, single upper electrode layer containing iridium and a second, single upper electrode layer containing titanium as a top layer of the first, single upper electrode, wherein the first single upper electrode layer and the second single upper electrode layer are disposed above the piezoelectric layers in such a manner as to face the first and second lower electrodes; and a lead electrode comprising at least a first lead electrode that is formed in connection to the second upper electrode layer and contains nickel and chromium.

2. The piezoelectric element of claim 1, wherein the lead electrode further comprises a second lead electrode disposed above the first lead electrode.

3. A liquid ejecting head, comprising:

a pressure generating chamber communicating with a nozzle opening that ejects liquid; and the piezoelectric element according to claim 1 as a pressure generating unit for changing the pressure of the pressure generating chamber.

4. The piezoelectric element of claim 2, wherein the second lead electrode comprises gold.

5. A liquid ejecting apparatus, comprising the liquid ejecting head according to claim 3.

6. A liquid ejecting head, comprising:

a pressure generating chamber communicating with a nozzle opening that ejects liquid; and the piezoelectric element according to claim 4 as a pressure generating unit for changing the pressure of the pressure generating chamber.

7. A liquid ejecting apparatus, comprising the liquid ejecting head according to claim 6.

8. A method for manufacturing a piezoelectric element, comprising;

forming a plurality of lower electrodes, comprising at least a first and a second lower electrodes;

forming a plurality of piezoelectric layers, each of the plurality of piezoelectric layers formed above each of the plurality of lower electrodes;

forming a single first upper electrode layer, facing the first and second lower electrodes and comprising iridium, above the piezoelectric layers;

forming a single second upper electrode layer, comprising titanium, as a top layer of an upper electrode, on the first upper electrode layer, wherein the single second upper electrode layer is disposed to face the first and second lower electrodes;

forming the upper electrode, wherein the upper electrode comprises the single first upper electrode layer and the single second upper electrode layer, by patterning the single first upper electrode layer and the single second upper electrode layer;

forming a first lead electrode, comprising nickel and chromium, on the single second upper electrode layer;

and forming a lead electrode, comprising at least the first lead electrode, by etching the first lead electrode by wet etching.

9. The method of claim 8, further comprising forming a second lead electrode on the first lead electrode, wherein forming the lead electrode comprises forming the lead electrode, comprising at least the first lead electrode and the second lead electrode, by etching the first lead electrode and the second lead electrode by wet etching.

10. The method of claim 8, wherein etching the first lead electrode comprises using an aqueous mixed solution comprising ammonium cerium nitrate and nitric acid.

11. The method of claim 9, wherein the second lead electrode comprises gold.

12. The method of claim 11, wherein etching the second lead electrode comprises using an aqueous mixed solution comprising iodine and potassium iodide.

* * * * *